United States Patent [19]

Hanajima et al.

[11] Patent Number: 4,864,085

[45] Date of Patent: Sep. 5, 1989

[54] KEYBOARD SWITCH

[75] Inventors: Tadashi Hanajima; Tatsuo Kato, both of Isesaki, Japan

[73] Assignee: Hosiden Electronics Co., Ltd., Osaka, Japan

[21] Appl. No.: 248,069

[22] Filed: Sep. 23, 1988

[30] Foreign Application Priority Data

Oct. 2, 1987 [JP] Japan ..... 62-151904[U]

[51] Int. Cl.[4] ..... H01H 3/12

[52] U.S. Cl. ..... 200/5 A; 200/513

[58] Field of Search ..... 200/5 A, 512, 513, 514, 200/516, 517

[56] References Cited

U.S. PATENT DOCUMENTS 4,678,880 7/1987 Koizumi et al. ..... 200/513

*Primary Examiner*—A. D. Pellinen
*Assistant Examiner*—Morris Ginsburg
*Attorney, Agent, or Firm*—Pollock, Vande Sande and Priddy

[57] ABSTRACT

A membrane switch sheet is disposed on a base plate and an adhesive layer is formed all over the membrane switch sheet. A positioning sheet, which has positioning holes respectively corresponding to membrane switches arranged on the membrane switch sheet, is disposed on the adhesive layer, and a tact plate having a normally upward curved portion is bonded to the adhesive layer in each positioning hole. A mounting plate is disposed on the positioning sheet at a distance therefrom. The mounting plate has a sleeve at a position corresponding to each tact plate. A stem is slidably received in the sleeve. The stem is capped with a key top formed integrally therewith. An acutating coiled spring is fixed at one end and engaged at the other end with the tact plate. When the key top is depressed, the coiled spring presses down the corresponding membrane switch through the tact plate, turning on the switch. At the same time, the curved portion of the tact plate is flexed downward, producing a click-like touch in response to the keying operation.

7 Claims, 4 Drawing Sheets

KEYBOARD SWITCH

BACKGROUND OF THE INVENTION

The present invention relates to a keyboard swich for use in an input device of an electronic computer, word processor, or the like.

A conventional keyboard switch, intended primarily for miniaturization, has an arrangement in which contact portions of so-called membrane switches are disposed on a plate and are each actuated using an actuating coiled spring provided in association with each key top. With this prior art keyboard switch, the keying operation is not accompanied by what is called a tact feeling or click-like touch. Accordingly, in the case of entering characters or symbols through the keyboard, it is difficult for an operator to judge from his or her finger's touch on each key whether he or she depressed the key without fail.

SUMMARY OF THE INVENTION

It is therefore an object of the present invention to provide a small-sized keyboard switch which employs membrane switches and transmits to the operator's finger a distinctive feeling of actuation.

According to the present invention, a membrane switch sheet having a plurality of membrane switches formed thereon is disposed on a base plate and an adhesive layer is provided all over the membrane switch sheet. A positioning sheet is disposed on the adhesive layer. The positioning sheet has positioning holes respectively corresponding to switches of the membrane switch sheet. A tact plate of a resilient material is positioned in each positioning hole and is bonded at its periphery to the adhesive layer. A mounting plate is fixed to the base plate in adjacent but spaced relation to the positioning sheet. The mounting plate has a positioning guide portion formed integrally therewith by which a key corresponding to each tact plate is positioned and guided thereto. The mounting plate further has a sleeve formed integrally therewith and extending therethrough in opposing relation to each tact plate. A stem is slidably received in each sleeve. The stem has a key top molded integrally therewith. Accordingly, the key top is supported by the mounting plate in a manner to be movable up and down. On end portion of an actuating coiled spring is put on a spring holder portion of the key top and the other end of the spring is held in contact with the tact plate.

The membrane sheet is made up of two conductor pattern sheets separated by a spacer sandwiched therebetween. When the key top is pressed down, contact patterns of the conductor pattern sheets are pressed by the actuating coiled spring into contact with each other through the tact plate, performing a switching operation. At this time, the actuating coiled spring and the tact plate act in cooperation to transmit a click-like feeling to the operator's finger. A sound by flexure of the tact plate is suppressed by the presence of the adhesive layer, produced a quieting effect. The adhesive layer serves to fix the tact plate as well.

DESCRIPTION OF THE PREFERRED EMBODIMENTS

Figure 1:
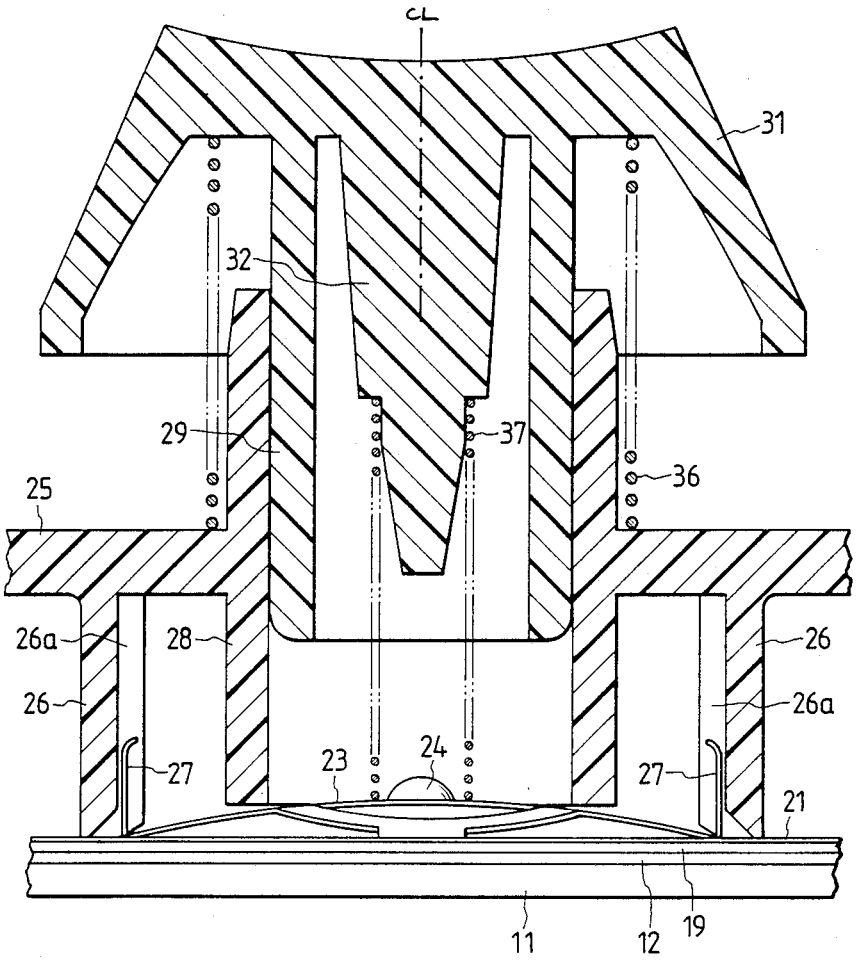
FIG. 1 is a sectional view illustrating one switch section of the keyboard of the present invention.
Figure 2:
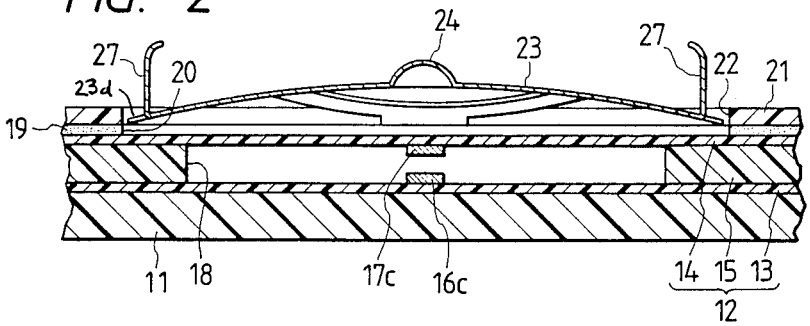
FIG. 2 is an enlarged sectional view showing a membrane switch and its vicinity.
Figure 3:
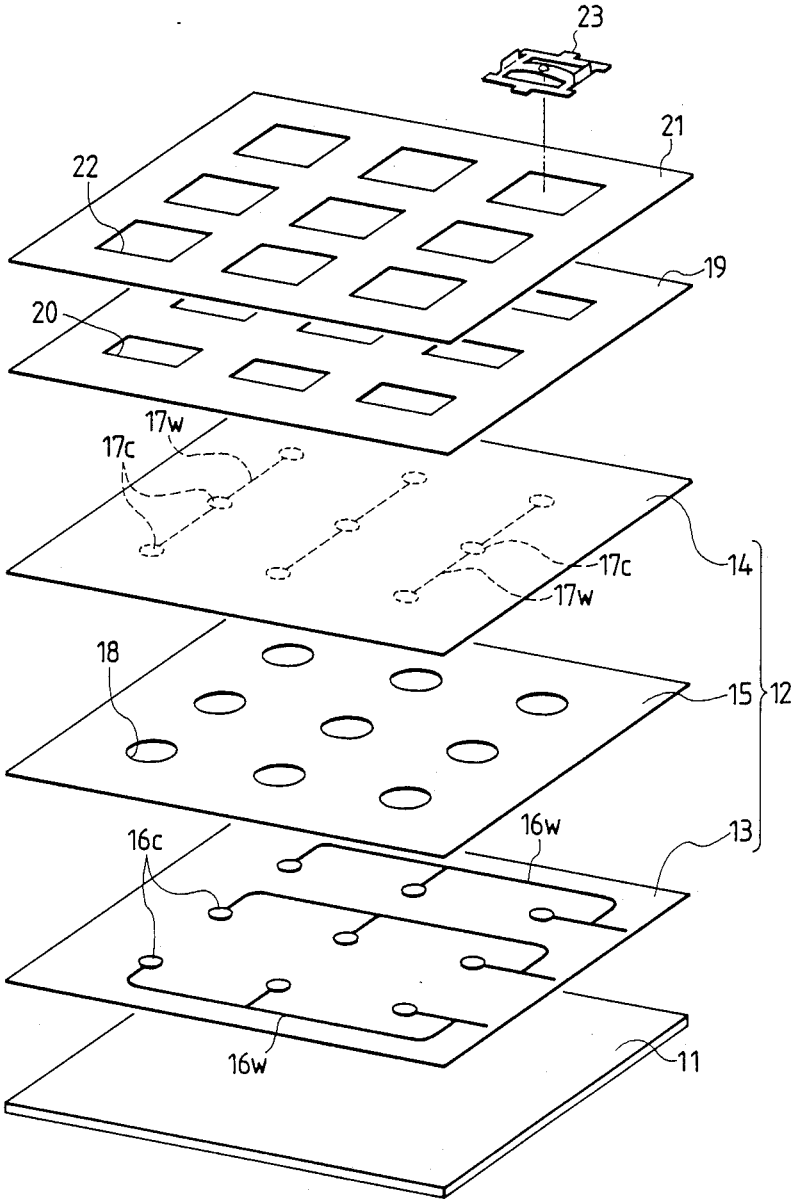
FIG. 3 is an exploded view showing a membrane switch sheet 12 and respective sheet members holding it therebetween.

FIG. 1 shows, in section, one switch section of the keyboard switch of the present invention. A base plate 11 is, for example, an iron plate having rigidity, over which a membrane switch sheet 12 is disposed. The membrane switch sheet 12 forms a plurality of membrane switch arrays and its two conductor pattern sheets 13 and 14 are separated by a spacer 15 interposed therebetween as shown in FIGS. 2 and 3. On the inner opposed surfaces of the pattern sheets 13 and 14 there are formed, by conductive foil patterns, opposed contact patterns 16*c* and 17*c* and leads 16*w* and 17*w* connected thereto. The spacer 15 has a plurality of circular holes 18 each of which is sufficiently larger in diameter than each pair of opposed contact patterns 16*c* and 17*c* so that each such pair of contact patterns can contact one another through one of said holes 18. The membrane switch sheet 12 is covered over the entire surface area thereof with an adhesive layer 19. The adhesive layer 19 is formed by, for example, a double coated adhesive sheet, or it may be formed by coating an adhesive directly all over the membrane switch sheet 12. The adhesive layer 19 has rectangular holes 20 of about the same size as the circular holes 18 of the spacer 15 at positions corresponding to holes 18. The adhesive layer 19 is covered with a positioning sheet 21. The positioning sheet 21 has positioning holes 22 a little larger than the holes 20 of the adhesive layer 19 at positions corresponding to holes 20. In each positioning hole 22 a tact plate 23 of a spring material is disposed in such a manner as to be positioned by the inner walls of the positioning holes 22. The tact plate 23 is bonded to that portion 19*a* of the adhesive layer 19 exposed in the positioning hole 22 of the positioning sheet 21 around the hole 20 of the layer 19.

Figure 4:
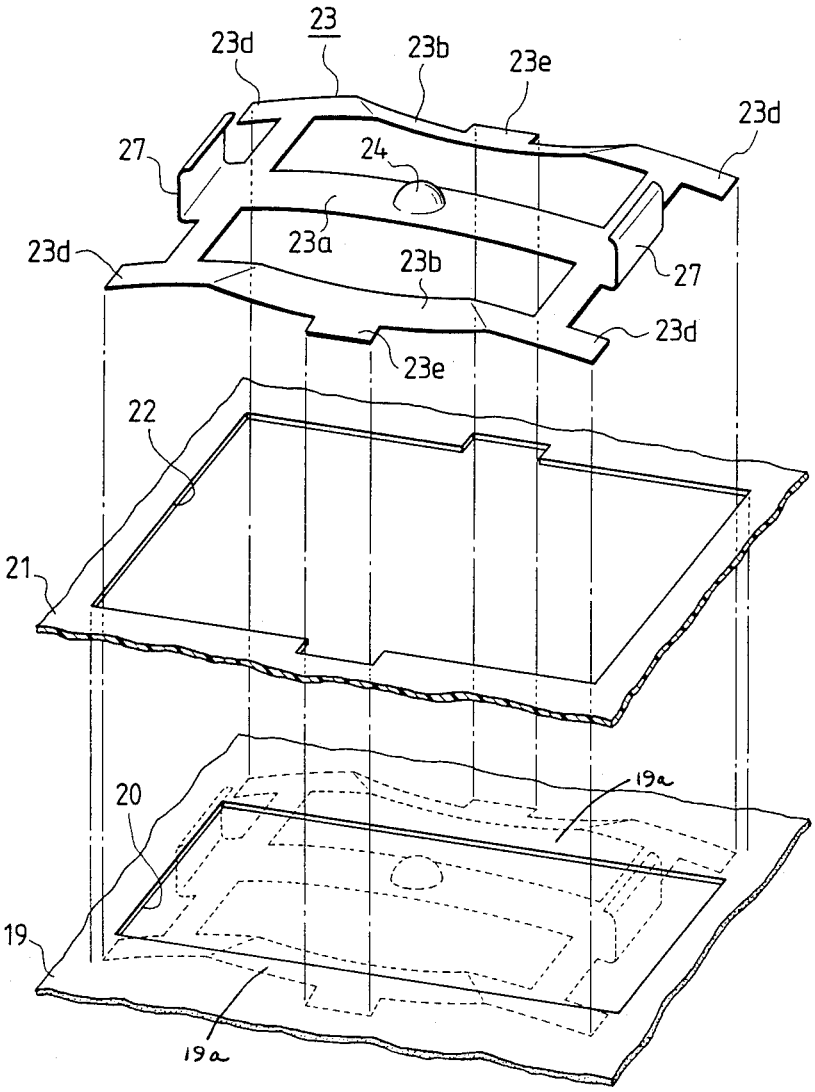
FIG. 4 is an exploded perspective view showing a tact plate 23 and respective sheet members holding it therebetween.

FIG. 4 is an exploded view showing a detailed structure of the tact plate 23 and the positional relationships thereto of the rectangular hole 20 of the adhesive layer 19 and the positioning hole 22 of the positioning sheet 21. The tact plate 23 is made by punching a flat piece of desired shape from resilient sheet metal and then bending it. The tact plate 23 is a frame substantially rectangular in shape and has two adjoining rectangular windows formed with a center arm 23*a* and two side arms 23*b* extending in parallel. The center arm 23*a* is curved upwardly over the entire length thereof. Each side arm 23*b* is curved upwardly at both end portions in the same manner as the two end portions of the center arm 23*a*, but the central portion of each side arm 23*b* is curved downwardly. With such a structure, when the tact plate is pressed by an external force from above at the central portion of the center arm 23*a*, the upwardly curved center arm 23*a* will flex downward with a clicking touch, and when the external force is removed, it will automatically flex back to its initial upwardly curved position. The center arm 23*a* has an upward protrusion 23 centrally thereof and upstanding guide pieces 27 extending from the opposite ends thereof.

Each side arm 23*b* has at its two end portions legs 23*d* extending outwardly of the frame of the tact plate 23 and at the center an outwardly projecting piece 23*e* formed integrally therewith. The positioning hole 22 of the positioning sheet 21 is shaped and sized so that marginal edges of the legs 23*d* and projecting pieces 23*e* may not come into contact with edges of the hole 22, but this is not necessarily requisite. Each rectangular hole 20 of the adhesive layer 19 is larger in width and length than the center arm 23*a* of the tact plate 23 so as to prevent the center arm 23*a* from sticking to the adhesive layer 19 when the center arm 23*a* is depressed downward. Further, the size of each hole 20 is chosen so that the legs 23*d* and the projecting pieces 23*e* of the adjacent tact plate 23 lie on the adhesive layer 19. Accordingly, the tact plate 23 is bonded at the marginal portions of its legs 23*d* and projecting pieces 23*e* to the adhesive layer 19 as indicated by the broken lines. In practice, alternating flexure of the center arm 23*a* of the tact plate 23 will cause the portions of the legs 23*d* which contact the adhesive layer 19 to slightly move back and forth in the direction in which each side arm 23*b* extends.

As shown in FIG. 1, a mounting plate 25 of synthetic resin is disposed in adjacent but spaced relation to the positioning sheet 21. The mounting plate 25 is fixed, by fixing means (not shown), to the base plate 11 at the peripheral portion of the keyboard. Extending in parallel from the mounting plate 25 toward the plate 11 are a pair of guide portions 26 corresponding to each tact plate 23. Grooves 26*a* in the guide portions 26 receive the guide pieces 27 of the tack plate 23, thus holding the tact plate between the pair of guide portions 26.

The mounting plate 25 has a sleeve 28 molded integrally therewith between the pair of guide portions 26 corresponding to each tact plate 23. The sleeve 28 extends from the mounting plate 25 also on the opposite side from the base plate 11. A tubular stem 29 is slidably received in the sleeve 28. The stem 29 is made of synthetic resin and capped with a key top 31 integrally molded therewith. The key top 31 has a columnar spring holder 32 molded integrally therewith and extending down in the sleeve 28.

Figure 5:
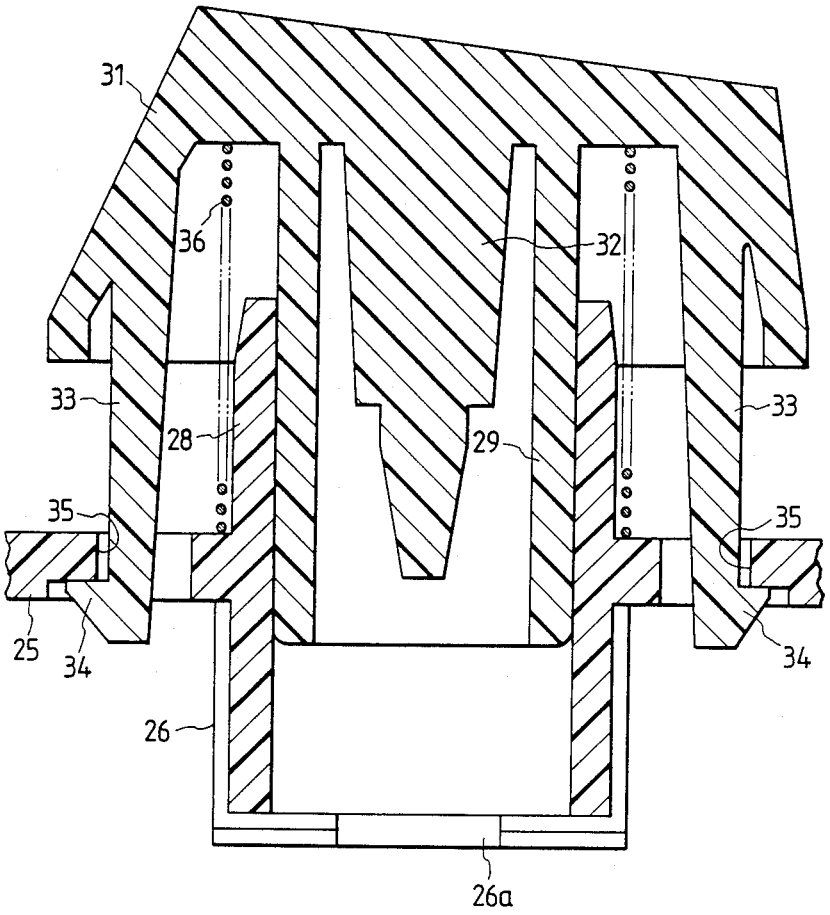
FIG. 5 is a sectional view along the center line CL of the FIG. 1 actuating key section in a plane perpendicular to that shown in FIG. 1.

FIG. 5 illustrates in section one control key section in a plane perpendicular to the mounting plate 25 and the section shown in FIG. 1. The key top 31 is held by the mounting plate 25 in such a manner that the key top slidably moves up and down in the sleeve 28 but will not slip out therefrom. To this end, the key top 31 has a pair of downward legs 33 molded integrally therewith, and each leg 33 has at its lower end a pawl 34, which is received in and engaged with an engaging hole 35 of the mounting plate 25. In this example, a return spring 36 is provided between the mounting plate 25 and the key top 31 on the outside of the sleeve 28, by which the key top 31 is always biased upward.

As illustrated in FIG. 1, the small-diametered lower end portion of the spring holder 32 of the key top 31 is pressed into one end portion of an actuating coiled spring 37 to hold it firmly. The other end of the actuating coiled spring 37 is engaged with and positioned by the protrusion 24.

With the structure described above, when the key top 31 is pressed down to a predetermined position where the downward force of the actuating coiled spring 37 exceeds the upward force of the tact plate 23, the plate 23 is abruptly flexed downward, by which the pattern sheet 14 is depressed to bring the contact pattern 17*c* into contact with the contact pattern 16*c*, turning on the membrane switch. When released from the downward force, the key top 31 returns to its initial position by the spring force of the return spring 36 and the tact plate 23 flexes upward due to its own spring force, with the result that the contact pattern 17*c* is disengaged from the contact pattern 16*c*, thus turning off the switch.

It is also possible to omit the return spring 36 and to rely on the actuating coiled spring 37 to return key top 31 to its initial position.

As described above, according to the present invention, flexure of the tact plate gives a click-like touch to an operator's finger for each keying operation, ensuring the operation. The tact plate 23 is positioned by the positioning hole 22 of the positioning sheet 21 and fixed to the adhesive layer 19, and hence it can easily be held in position. In addition, the adhesive layer 19 produces a quieting effect that suppresses sounds which are produced by flexure of the tact plate 23. Thus, the adhesive layer 19 eliminates the necessity of using a rubber cushion for silencing, reduces the manufacturing costs of the keyboard accordingly, produces an excellent quieting effect, and ensures holding of the tact plate 23 in position.

To prevent the lower end of the actuating coiled spring 37 from getting out of position, it is possible to provide a guide inwardly projecting from the lower end of the sleeve 28. However, the presence of such a guide will make it difficult to put the upper end portion of the actuating coiled spring 37 on the holder 32 by automation. In contrast thereto, in the above-described embodiment of the present invention the lower end of the actuating coiled spring 37 is positioned by the protrusion 24 and will not slip out of position. Moreover, since the lower end of the sleeve 28 is open, the actuating coiled spring 37 can easily be put on the holder 32 by automation.

By omitting the tact plate 23 a switch can also be obtained which does not produce the afore-mentioned click-like touch in the keying operation. That is to say, the tact plate 23 can easily be included or excluded as required.

It will be apparent that many modifications and variations may be effected without departing from the scope of the novel concepts of the present invention.

What is claimed is:

1. A keyboard switch comprising:

a base plate;

a membrane switch sheet having arranged therein a plurality of membrane switches and disposed on the base plate;

an adhesive layer provided all over the membrane switch sheet;

a positioning sheet disposed on the adhesive layer and having positioning holes respectively corresponding to the plurality of membrane switches arranged on the membrane switch sheet;

a resilient tact plate disposed on the adhesive layer and positioned in each positioning hole, the tact plate having a normally upwardly curved portion which can be flexed downward by an external force;

a mounting plate disposed in adjacent but spaced relation to the positioning sheet and fixed to the base plate;

at least one guide portion formed integrally with the mounting plate and extending therefrom, for guiding the tact plate;

a sleeve formed integrally with the mounting plate and extending therethrough in opposing relation to each tact plate;

a tubular stem slidably received in each sleeve;

a key top formed integrally with the stem on top of it and vertically movably mounted on the mounting plate; and an actuating coiled spring having one end portion pressed into the stem and engaged at its other end with the curved portion of the tact plate.

2. The keyboard switch of claim 1, wherein the adhesive layer has a plurality of holes respectively opposite the curved portion of each tact plate.

3. The keyboard switch of claim 1, wherein each tact plate has an upward protrusion at the curved portion for engagement with the other end of the actuating coiled spring.

4. The keyboard switch of claim 1, wherein each tact plate has a plurality of legs formed integrally therewith, the legs being bonded to the adhesive layer.

5. The keyboard switch of claim 1, wherein each tact plate has at least one upstanding guide piece formed integrally therewith, the guide piece being engaged with the guide portion extending from the mounting plate.

6. The keyboard switch of claim 1 wherein each tact plate comprises a sheet of resilient metal shaped to provide a band-like center arm and two side arms extending parallel thereto on both sides thereof, said center and side arms being interconnected at their end portions, and the band-like center arm being curved to form the curved portion.

7. The keyboard switch of claim 1, wherein the mounting plate has at least one through hole in the vicinity of the sleeve and the key top has at least one leg formed integrally therewith and received in the through hole, the leg having an engaging portion for engagement with the through hole to prevent the leg from slipping out of said through hole.

* * * * *